US005558532A

United States Patent [19]

Hopper

[11] Patent Number: 5,558,532

[45] Date of Patent: Sep. 24, 1996

[54] ELECTRICAL CONNECTION

[75] Inventor: Hans P. Hopper, Aberdeen, United Kingdom

[73] Assignee: Cooper Cameron Corporation, Houston, Tex.

[21] Appl. No.: 241,537

[22] Filed: May 12, 1994

[30] Foreign Application Priority Data

Aug. 4, 1993 [EP] European Pat. Off. ..... 93306162

[51] Int. Cl.[6] ..... H01R 13/629

[52] U.S. Cl. ..... 439/310; 439/201

[58] Field of Search ..... 439/190–195, 439/310, 201, 204, 489, 490; 166/65.1, 66.4

[56] References Cited

U.S. PATENT DOCUMENTS

| | | | |
|---|---|---|---|
| 2,846,013 | 8/1958 | Davis | 166/75 |
| 3,049,371 | 7/1962 | Rector | 166/86 |
| 3,151,892 | 10/1964 | Word et al. | 285/137 |
| 3,635,184 | 1/1972 | Liautaud | 114/51 |
| 3,638,732 | 2/1972 | Huntsinger et al. | 166/65 |
| 3,807,497 | 4/1974 | Baugh | 166/85 |
| 3,848,949 | 11/1974 | Falkner | 439/310 |
| 4,491,176 | 1/1985 | Reed | 166/65 R |
| 4,736,799 | 4/1988 | Ahlstone | 166/348 |
| 4,907,980 | 3/1990 | Wagaman | 439/199 |
| 5,194,012 | 3/1993 | Cairns | 439/201 |

FOREIGN PATENT DOCUMENTS

| | | | |
|---|---|---|---|
| 2059081 | 6/1971 | Germany | 439/138 |
| 2058881 | 9/1979 | United Kingdom . | |
| 2165284 | 4/1986 | United Kingdom . | |

*Primary Examiner*—Neil Abrams
*Attorney, Agent, or Firm*—Conley, Rose & Tayon

[57] ABSTRACT

An electrical connection across a peripheral surface through a sealed enclosure (34A) in a radial plane between a tubing hanger (5) and a surrounding support member (3). The connection involves a coupling element (17) in the tubing hanger and an electrical contact supporting shuttle (20) which can reciprocate from a position wholly within the support member, across the interface and into electrical connection with the coupling element, without producing any movement of a cable (9,10,11,15) leading into a sealed enclosure within the support. In certain embodiments (FIGS. 3–7), the shuttle (20) is driven by threaded engagement with a rotatable drive sleeve (30) and includes a sleeve (21) that is reciprocated over a stationary power core (22, 22'). The shuttle is also filled with a dielectric gel (26) contained within a flexible bladder (25). A sensor contact (35) can be used to indicate full retraction of the shuttle (FIG. 5).

9 Claims, 9 Drawing Sheets

ELECTRICAL CONNECTION

BACKGROUND OF THE INVENTION

1. Field of the Invention

The present invention relates to an electrical connection between a radially inner and a radially outer member, for example, in a housing assembly of a wellhead of an oil or gas field.

2. Description of the Related Art

Electrical connections are required in housing assemblies for high power circuits for running downhole equipment such as pumps and heating coils, and for electrical signals to and from downhole equipment. Such electrical connections are conventionally made through the top of the tubing hanger once the tubing hanger is landed in a housing or wellhead. The space available for the connections is therefore limited. This may result in the production bore being off-centre which has serious operational implications in ensuring equipment is correctly aligned. Furthermore, the blow out preventer has to be removed for access to the top of the tubing hanger. The tubing hanger then provides the only barrier, which causes a safety problem if the well is live.

The electrical connection must pass through a pressure boundary to the tubing hanger. In the case of a power core, full insulation is needed. As good insulators have generally poor sealing properties, sealing at the pressure boundary at the well temperature is difficult.

According to the present invention, an assembly providing an electrical connection across an interface between a radially inner member and a surrounding radially outer member, comprises a sealed enclosure between the inner and outer members; a cable which leads to the enclosure and is fixed and sealed to a wall of the enclosure, and which has at least one conducting core; an electrical coupling element within the inner member; and a shuttle which is reciprocatable radially inwardly from a disconnected position wholly within the outer member to a connected position in which the shuttle makes an electrical connection from the conductor core to the electrical coupling element.

As the connection is made across a peripheral surface in a radial plane, it does not have to be through the top of the inner member, e.g. a tubing hanger. Therefore the space limitation of the prior art is avoided. Furthermore, when the invention is applied to the housing of a wellhead assembly, it eliminates the need to remove the blow out preventer.

It is the shuttle which bridges the gap across the enclosure between the inner and outer members and therefore prevents damage to the cable which is not exposed in the potentially hostile pressurised region between the two members. No electrical cables or components are required to move through a pressure barrier so that make up can be achieved in a constant volume void irrespective of the pressure.

As the shuttle does not have to contain pressure, there is no problem achieving an insulated connection.

In one embodiment, generally suitable for an electrical signal, a connecting cable connected to the cable is coiled within the enclosure and is fixed to the shuttle. The connecting cable may be an extension of the cable core. When the electrical connection is made up, the coil is simply extended.

SUMMARY OF THE INVENTION

Such flexible coiled cables are not practical for making electrical connections for power supplies. Therefore, as an alternative, the shuttle is slidable with respect to a fixed power core which provides a coupling element electrically connected to the cable core. Thus, only the shuttle is moved. The shuttle may be provided at either or both ends with a pin which mates with a corresponding socket of the respective coupling element to make the electrical connections, or the shuttle may be provided at either or both ends with a socket which mates with a corresponding pin of the respective coupling element to make the electrical connections.

For a large concentric production bore, the invention may be used in the housing of a wellhead assembly in which a plurality of connections are circumferentially disposed about the longitudinal axis of the tubing hanger, and have their lines of operation offset from the axis of the tubing hanger. For three phase power, three separate connections can be used. Preferably the lines of operation are tangential to a circle centred on the axis of the tubing hanger.

The space within the shuttle may be filled with a dielectric gel which is contained within a flexible bladder exposed to the surrounding pressure. This ensures that the pressure inside the shuttle remains constant with respect to the surrounding pressure and prevents any ingress of hostile fluids that could contaminate the gel. A series of gland type diaphragms may be provided at each end of the shuttle which seal with the respective coupling element, or close up in the absence of a coupling element in order to retain the gel within the shuttle. The complete sealing allows the connection to be made up under pressure.

The shuttle may be reciprocated by rotation of a screw threaded element coupled to the shuttle.

As an alternative to providing a plurality of connections circumferentially disposed about the axis of the tubing hanger, a plurality of cables may be connected in a single connection. In this case, there may be insufficient room in the wall of the tubing hanger to accommodate a set of single 90° couplings around a concentric bore. It may therefore be necessary to offset the bore of the tubing hanger from the axis of the tubing hanger.

This arrangement means that only one diver or ROV operation is necessary to make several connections, thereby reducing the time taken, and hence the costs. Furthermore the cable does not have to be separated and then spliced together down the well.

One particularly advantageous way of offsetting the bore is to provide an axial bore in the top of the tubing hanger, which bore leads into an offset bore having a diameter smaller than that of the axial bore allowing a tubing string to be supported with its axis offset from the axis of the tubing hanger. This has the advantage that operations associated with the top of the tubing hanger, such as running tool operations, can still be performed in concentric mode. Furthermore, double barrier protection can be provided in the form of two concentric plugs in the axial bore. This means a BOP can be installed prior to the removal of the plugs, allowing safe access to a live well irrespective of its condition of completion.

This offset bore configuration provides an independent invention as it can be used in any application where more space is required at one side of the tubing hanger wall.

BRIEF DESCRIPTION OF THE DRAWINGS

Wellhead assemblies incorporating examples of assemblies providing electrical connections according to the present invention will now be described with reference to the accompanying drawings, in which.

DETAILED DESCRIPTION OF THE PREFERRED EMBODIMENTS

Figure 1:
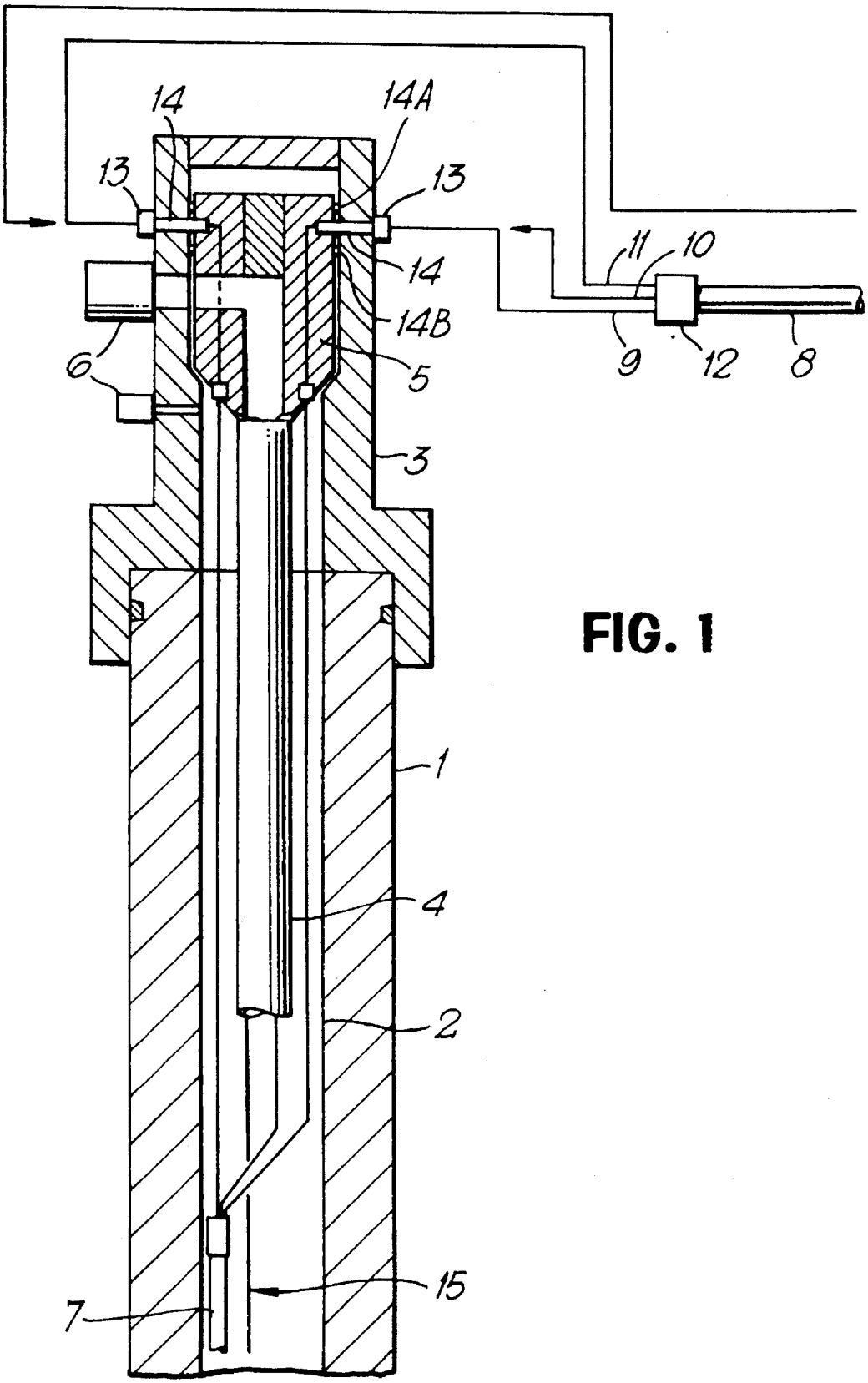
FIG. 1 is a diagrammatic axial section through the wellhead assembly.

The wellhead assembly comprises a wellhead 1 with a production casing 2. A spool body 3, such as a spool tree described in our copending application number 92305014.0, is installed on top of the wellhead. Production tubing 4 is run into the production casing until a tubing hanger 5 seats in the spool tree 3. The necessary valves and pipe work 6 are provided for the spool tree 3.

A downhole pump 7 is provided with three phase power from a power cable 8. This cable is split into three single power cores 9,10 and 11 at a junction box 12. The three single power cores 9,10 and 11 are connected to the spool tree 3 by three coupling housings 13 circumferentially disposed around the spool tree 3. Only two of the couplings are shown in FIG. 1.

Three connections 14 which are constructed in accordance with a first example of the present invention provide the power connection bridging the gap between the spool tree 3 and the tubing hanger 5. Seals 14A,14B are provided above and below the connections 14 respectively. These seal with the spool tree 3 and tubing hanger 5 and together with seals to be described later form a sealed enclosure through which the connections 14 penetrate. The power cables run from the tubing hanger 5 down the well between the production casing 2 and the production tubing 4 to the single power cable 7. A downhole gauge cable 15 is additionally provided and a connection 16 for this (not shown in FIG. 1), constructed in accordance with a second example of the present invention, is provided between the spool tree 3 and the tubing hanger 5.

Figure 2:
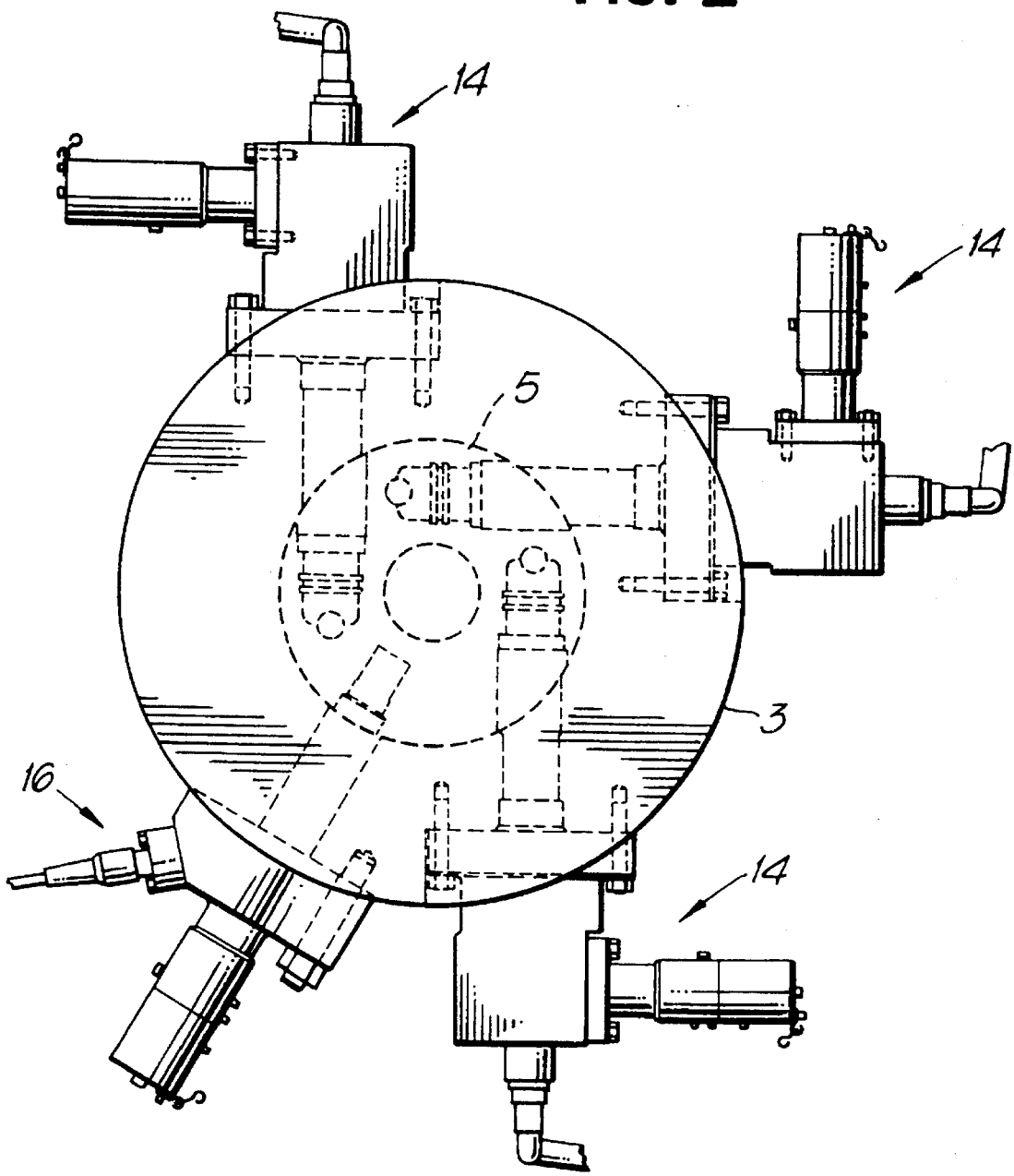
FIG. 2 is a radial section through the wellhead assembly showing first and second examples of the connector.

FIG. 2 shows the three power connections 14 and one signal connection 16 circumferentially disposed around the spool tree 3 in a common radial plane. The power connections 14 are mounted tangentially, allowing more space for a larger concentric production bore.

Figure 3:
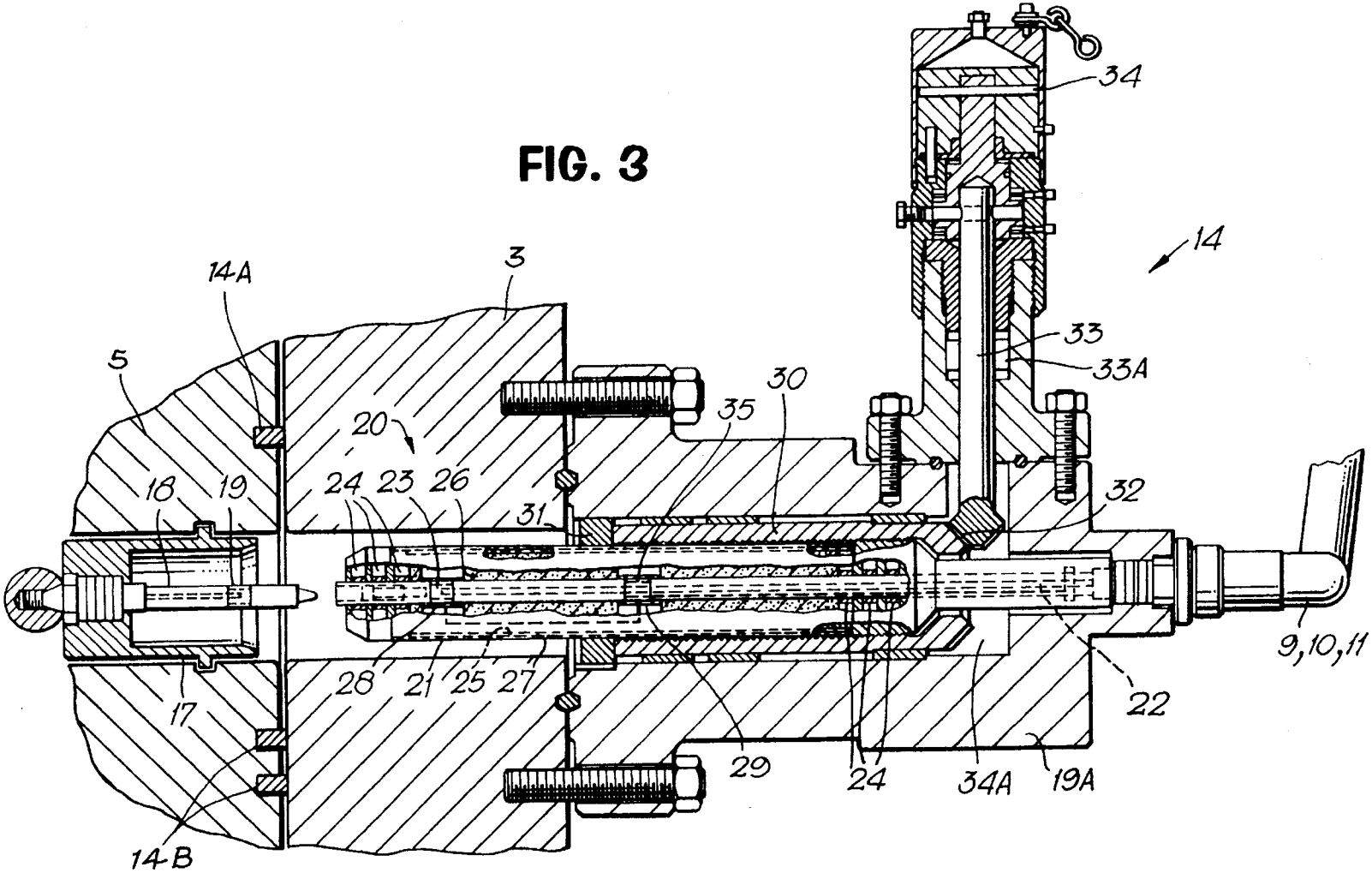
FIG. 3 is a section through a first example of a connector in the disconnected position.
Figure 4:
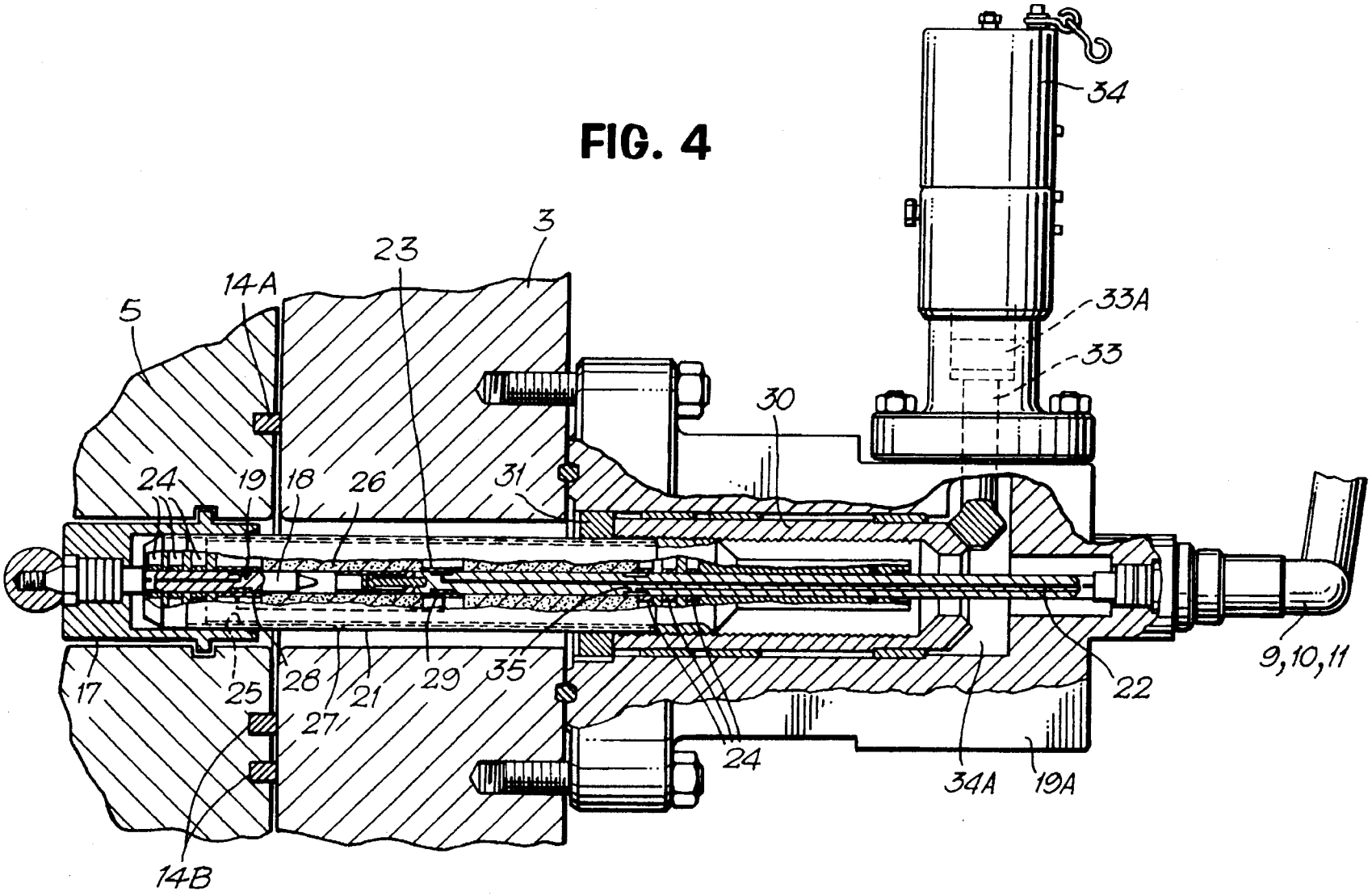
FIG. 4 is a view similar to FIG. 3 in the connected position.

The power connection 14 according to the first example of the invention is shown in greater detail in FIGS. 3 and 4. A plug 17 is provided in the tubing hanger 5 and has a pin 18 provided with an electrical contact portion 19. A housing 19A is secured to the spool tree 3 and contains a shuttle 20. The shuttle 20 comprises a sleeve 21 which is slidable on a power core 22. A power cable 9,10,11 is sealed to the housing 19A and is screwed, potted and insulated in the conventional way. The power core 22 is electrically coupled to the power cable 9,10 and 11 through the sealing to the housing 19A. The core 22 is provided, at the end adjacent to the tubing hanger 5 with an electrical contact portion 23. Three gland type diaphragms 24 are provided at each end of the sleeve 21 and serve to seal between the sleeve 21 and power core 22,18. A flexible bladder 25 is provided within the sleeve 21, joins at each end to the diaphragms 24, and is filled with dielectric gel 26. A vent hole 27 in the sleeve 21 exposes the bladder to the surrounding pressure. The sleeve 21 has a first electrical contact portion 28 at its end closest to the tubing hanger 5 and a second electrical contact portion 29 spaced further inside the sleeve 21 than the first contacting portion 28.

The mechanism for driving the sleeve comprises a rotatable drive sleeve 30 which has a female screw thread engaged with a male screw thread on the sleeve 21. An anti-rotation ring 31 prevents rotation of the sleeve 21. The drive sleeve 30 is coupled by means of a bevel gear 32 to a drive shaft 33. The shaft is sealed in the housing 19A by a bonnet valve seal 33A. This sleeve is driven by manual drive 34. Rotation of the drive shaft 33 causes rotation of the drive sleeve 30 which, by virtue of the anti-rotation ring 31, is translated to lateral movement of the sleeve 21. The manual drive 34 may be operated either by a diver or by ROV. Alternatively a modified sleeve can be used which is hydraulically operated.

The sealing between the cable 9,10,11 and the housing 19A, together with the seals 14A,14B and bonnet valve seal 33A form a sealed enclosure 34A in which the shuttle 20 reciprocates.

Figure 5:
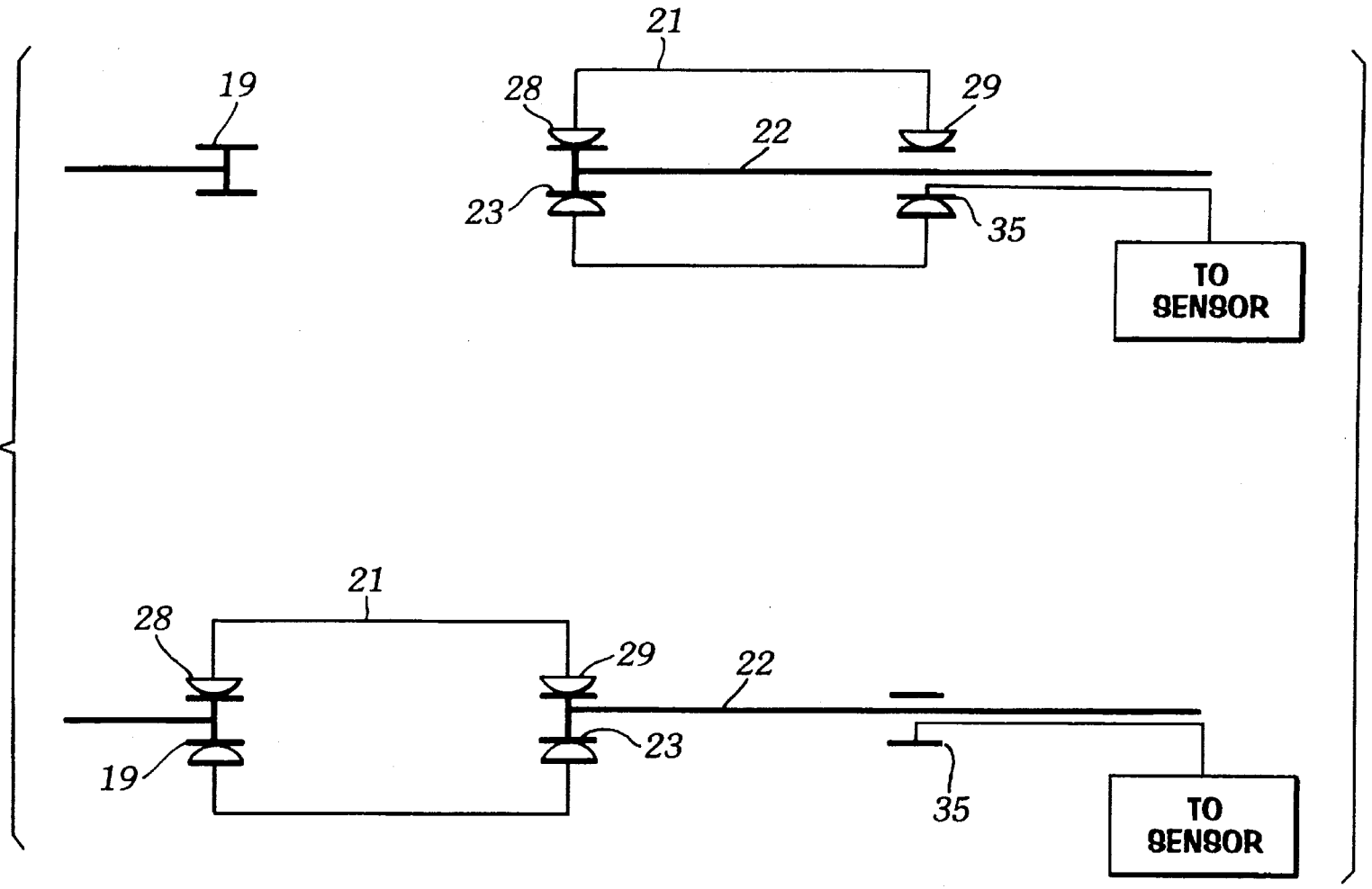
FIG. 5 is a diagram illustrating the principle of operation of the first example.

When the tubing hanger 5 is run into the spool tree 3, the sleeves 21 of the three power connections 14 are in their fully retracted positions, as shown in the top two examples illustrated in FIG. 2, in which they do not project into the production bore. Once the tubing hanger 5 has landed in the correct orientation, the sealed enclosure 34A is formed by seals 14A,14B. The enclosure 34A can then be flushed with dielectric oil through a system of ducts and valves (such as the valve 34B and duct 34C shown in FIG. 8) in order to remove any well completion fluid which may be trapped in the enclosure. The electrical connection can then be made up. Thus, manual drive 34 is operated, as described above, to cause the socket to move across the gap between the spool tree 3 and tubing hanger 5 and engage with the plug 17. As shown in FIG. 5, the first electrical contact portions 28 of the sleeve 21 are moved into contact with the electrical contact portions 19 of the pin 18 and the second electrical contact portions 29 of the sleeve 21 are moved into a electrical contact with the electrical contact portions 23 of the power core 22. Thus the electrical connection between the power core 22 and plug 17 is achieved. It should be noted that only the sleeve 21 moves. The sleeve 21 is within a pressure contained void which is pressure balanced by the bladder 25. The movement of the sleeve 21 and the electrical insulation are therefore not dependent on pressure.

Figure 8:
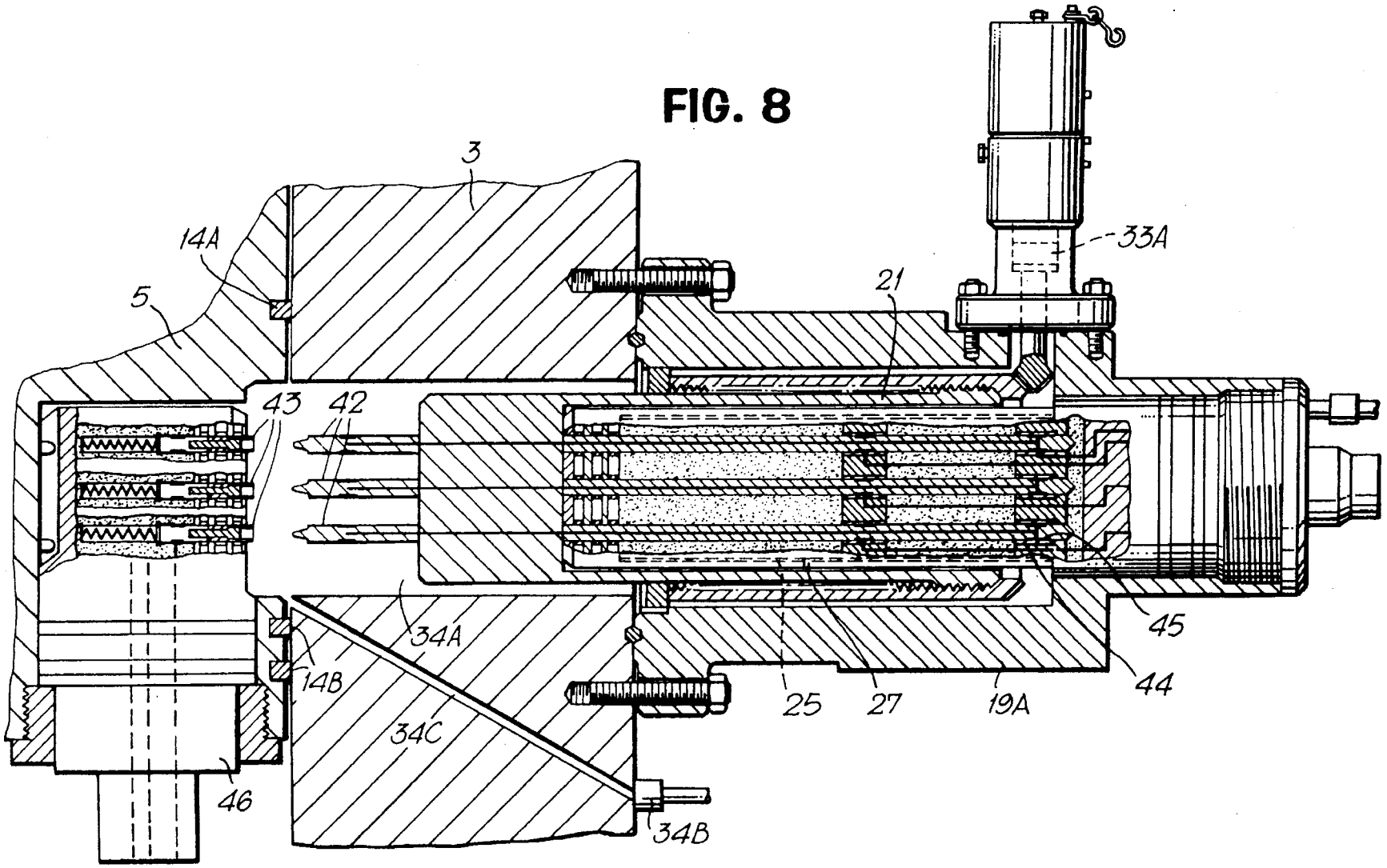
FIG. 8 is a section through a fourth example of a connector in the disconnected position.

The enclosure 34A can be periodically flushed with dielectric oil to remove any contaminants from the enclosure (e.g. through end duct 34C controlled by the valve 34B of FIG. 8).

As can further be seen from FIG. 5 a sensor contact 35 is provided which engages with the second electrical contact portion 29 of the sleeve 21 when the sleeve is in its fully retracted position. This then completes a circuit so an electrical signal will indicate that the sleeve 21 is in its fully retracted position.

Figure 6:
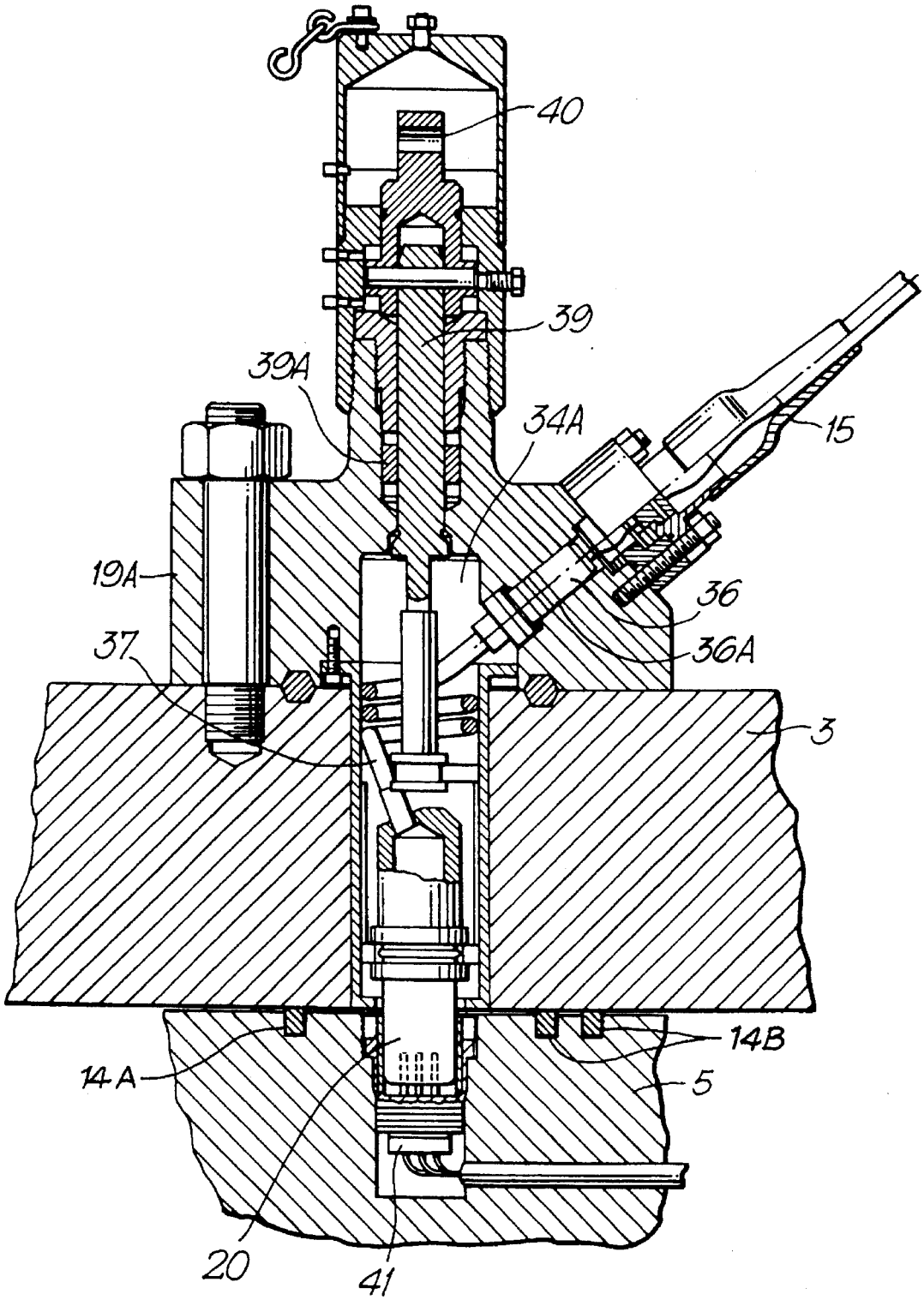
FIG. 6 is a section through a second example of a connector in the connected position.

FIG. 6 shows a connector suitable for a signal cable 15. The signal cable 15 is fixed to the side of the spool tree 3 and leads to a connector 36 which connects it to a connecting cable 37, which is coiled within a sealed enclosure 34A in the spool tree 3. The connector 36 is sealed to the housing 19A with seals 36A. The connecting cable 37 is directly attached to a shuttle 20. An actuating stem 39, which is provided at one end with a manually operable adapter 40, is threadably engaged with respect to a non-rotatable mandrel connected to the shuttle 20. Stem packing 39A seals the stem 39 to the housing 19A and together with seals 14A,14B,36A serves to define the sealed enclosure 34A. A socket 41 having three connections for signal cables is provided in the tubing hanger 5. The number of signal cable connections is dependent on the particular application of the socket and is typically between one and twelve. Although not shown in FIG. 6, the shuttle 20 is provided with the same arrangement of gland type diaphragms, bladder and dielectric gel as that described in relation to the first example.

Rotation of the actuating stem 39 causes axial movement of the shuttle 20 thus reciprocating it into and out of engagement with the socket 41. When the shuttle 20 is in its engaged position, the coil of connecting cable 37 is extended without tensioning the cable 15.

Figure 7:
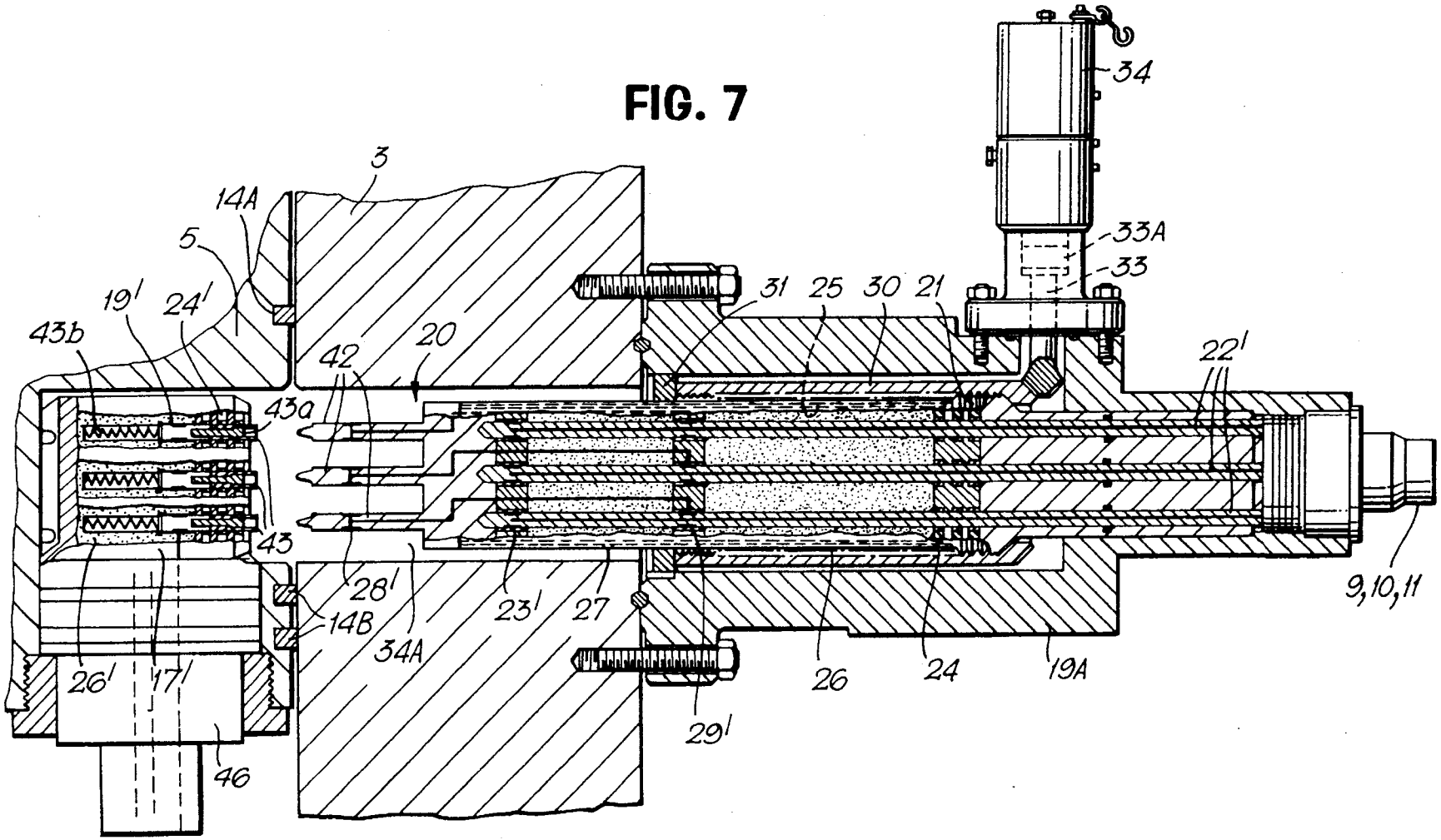
FIG. 7 is a section through a third example of a connector in the disconnected position.

A third example of a connector suitable for supplying three phase power is shown in FIG. 7. This is an alternative to the three separate power connections show in FIG. 2. The connector of the third example is similar to that described in FIGS. 3 and 4 and the same reference numerals have been used. There are two main differences between the examples. Firstly, a single sleeve 21 provides connections for three power cables 9,10,11 at a single location. Each cable is provided with its own core 22' and associated connections 19',23',28',29'. Secondly, the end of the sleeve 21 closest to the tubing hanger 5 is provided with three pins 42 which mate with respective sockets 43. This arrangement can of course be incorporated in a connector for a single cable such as that of the first example. Each socket 43 is provided with a dummy pin 43*a* which is retained within the socket 43, seals with the gland type diaphragms 24', and is urged outwardly by a respective spring 43*b*. When a pin 42 engages with a respective socket 43, the dummy pin 43*a* is pushed back against the resilience of the respective spring 43*b*. Either the dummy pin 43*a* or the pin 42 is always sealed to the gland type diaphragm 24' thus preventing leakage of the dielectric gel 26'. To allow extra space for the springs 43*b*, the connection can be fitted with its line of action at a tangent to a circle around the axis of the tubing hanger 5, in a similar manner to that shown for connections 14 shown in FIG. 2. Otherwise, a radial connection such as that shown in FIG. 2 for the connection 16 can be used.

Further pins and sockets can be provided for signal connections, or existing power pins can be provided with additional electrical contact portions for signals.

A fourth example is shown in FIG. 8 and differs from the examples show in FIG. 7 only in that the end of the shuttle 21 remote from the tubing hanger 5 is also provided with pins 44 which reciprocate with respect to sockets 45 which are fixed with respect to the spool tree 3. In this case, the gel 26 is contained in the sockets 43, 45 which remain stationary. If the sockets 43 in the tubing hanger 5 are damaged, they can be retrieved by pulling the hanger. The sockets 45 in the spool tree 3 are not subjected to a penetration operation so that gland type diaphragms should not be damaged. Should it be needed, replacement gel can simply be injected into the sockets 45.

Figure 9:
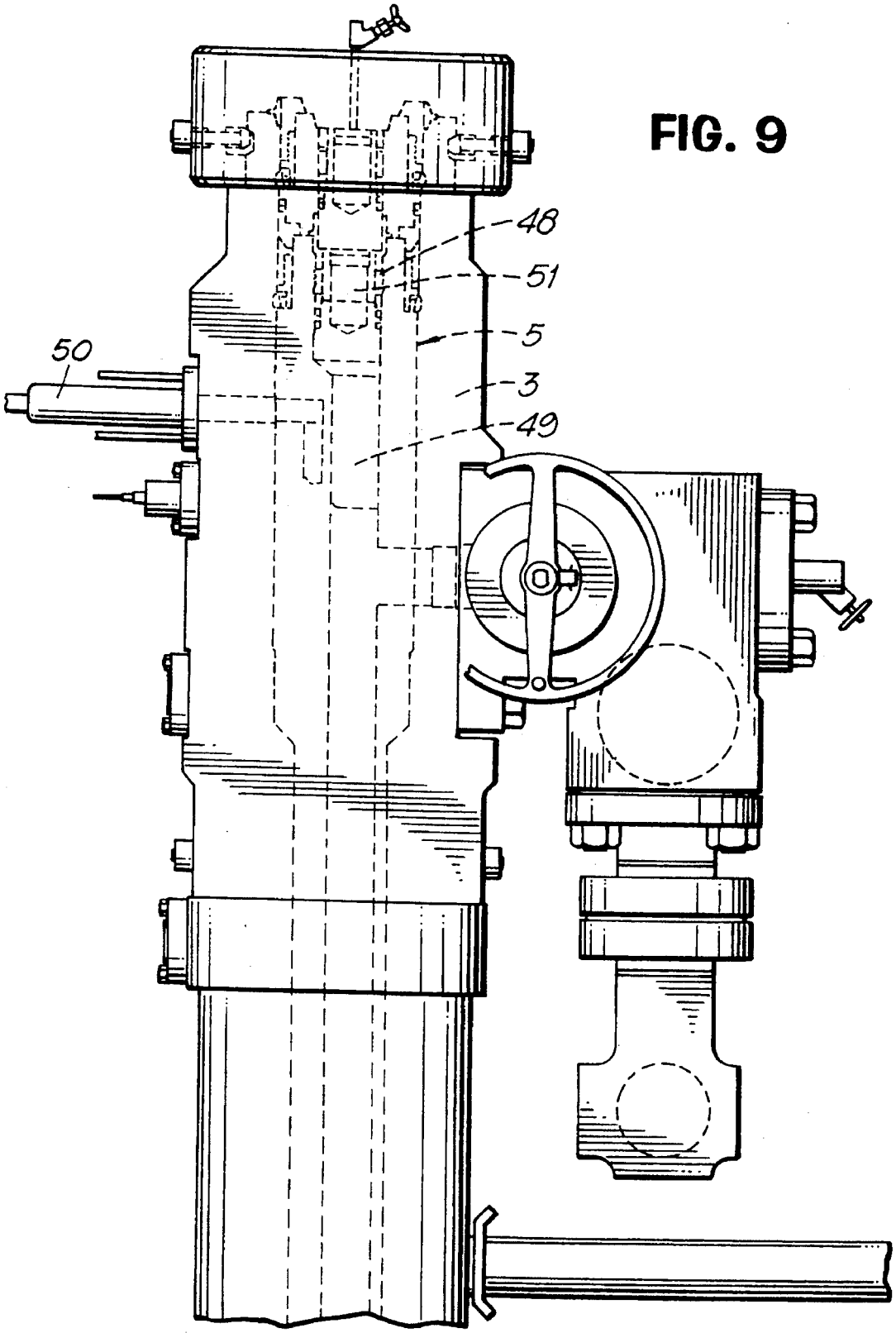
FIG. 9 is a view of a modified wellhead assembly incorporating a connector according to the third or fourth examples of the present invention.

As can be seen from FIGS. 7 and 8, a 90° connector 46 occupies a considerable amount of space within the tubing hanger 5. In order to allow for this, an example of a surface tree assembly, such as that shown in FIG. 9 can be provided. The tubing hanger 5 is provided with an axial bore portion 48. An offset bore portion 49 leads from the axial bore portion 48. The offset bore portion 49 is offset from and has a smaller diameter than the axial bore portion 48. As can be seen from FIG. 9, the offset bore portion 49 provides sufficient space for a connector 50 of the type according to the third and fourth examples. The provision of the axial bore portion 48 at the top of the tubing hanger ensures that many of the wellhead operations, such as running tool operations, can also be carried out in concentric mode. The well can be plugged using a conventional concentric plug 51. The surface tree can be readily adapted to provide a subsea tree assembly.

I claim:

1. An assembly providing an electrical connection across an interface between a radially inner member and a surrounding radially outer member, the assembly comprising a sealed enclosure defined between the inner and outer members; a cable which leads to the enclosure, and which has at least one conducting core; an electrical coupling element within the inner member; and a shuttle filled with a dielectric gel contained within a flexible bladder exposed to surrounding pressure, said shuttle being reciprocatable radially inwardly from a disconnected position wholly within the outer member to a connected position in which the shuttle makes an electrical connection between the conducting core and the electrical coupling element.

2. An assembly according to claim 1, wherein the shuttle is slidable on a fixed power core which provides a coupling element electrically connected to the conducting core.

3. An assembly according to claim 2, wherein the shuttle is provided at either or both ends with a pin which mates, in use, with a corresponding socket of the respective coupling element to make the electrical connection.

4. An assembly according to claim 1 or claim 2, wherein the shuttle is provided at either or both ends with a socket which mates, in use, with a corresponding pin of the respective coupling element to make the electrical connection.

5. An assembly according to claim 1, wherein a plurality of gland type diaphragms are provided at each end of the shuttle which seal with a conducting element in the coupling element, or, in the absence of said core, close up to seal themselves in order to retain the gel within the shuttle.

6. An assembly according to claim 1, wherein a connecting cable connected to the cable is coiled within the enclosure and is fixed to the shuttle.

7. An assembly according to claim 1, wherein the shuttle is reciprocated by rotation of a screw threaded element coupled to the shuttle.

8. An assembly according to claim 1 wherein the electrical connection provides a connection for a plurality of cables.

9. An assembly providing an electrical connection across an interface between a radially inner member and a surrounding radially outer member, the assembly comprising:

a. a sealed enclosure defined between the inner and outer members;

b. a cable which leads to the enclosure, and which has at least one conducting core within the outer member;

c. an electrical coupling element within the inner member;

d. a shuttle, said shuttle being reciprocatable radially inwardly from a disconnected position wholly within the outer member to a connected position in which the shuttle makes an electrical connection between the conducting core and the electrical coupling element; and e. a sensor contact arrangement which provides a signal indicative that the shuttle is in said disconnected position.

* * * * *